US006390400B1

(12) United States Patent
Huang

(10) Patent No.: US 6,390,400 B1
(45) Date of Patent: May 21, 2002

(54) BLADE OF PAPER SHREDDER

(76) Inventor: Li-Ming Wu Huang, 3F, No. 29, Lane 80, Sec. 1, DWU HWU S. Rd., Taipei (TW)

( * ) Notice: Subject to any disclaimer, the term of this patent is extended or adjusted under 35 U.S.C. 154(b) by 0 days.

(21) Appl. No.: 09/543,704

(22) Filed: Apr. 5, 2000

(51) Int. Cl.[7] ..... B02C 18/16
(52) U.S. Cl. ..... 241/295
(58) Field of Search ..... 241/295, 236

(56) References Cited

U.S. PATENT DOCUMENTS 4,009,838 A * 3/1977 Tashman ..... 241/236
4,061,278 A * 12/1977 Ehinger ..... 241/236
5,141,168 A * 8/1992 Pepper ..... 241/295
5,676,321 A * 10/1997 Kroger ..... 241/236

* cited by examiner

*Primary Examiner*—Mark Rosenbaum
(74) *Attorney, Agent, or Firm*—Browdy and Neimark, P.L.L.C.

(57) ABSTRACT

A blade is designed for use in the paper shredder and is formed of a main body which is provided in the center thereof with a through hole for mounting the blade on a shaft rod. The main body is provided in the periphery thereof with one or more notches, blade edges, edge head ends, and edge tail ends. The main body is provided in the outer edge surface thereof with a plurality of cavities.

4 Claims, 4 Drawing Sheets

BLADE OF PAPER SHREDDER

FIELD OF THE INVENTION

The present invention relates generally to a paper shredder, and more particularly to an improved blade of the paper shredder.

BACKGROUND OF THE INVENTION

As illustrated in FIG. 1, a prior art blade 80 of the paper shredder is provided in the outer periphery thereof with three arcuate portions 82, 83, and 84, which are formed by punching so as to form three teeth 85. The blade 80 is made of a round metal piece 81. The prior art blade 80 is used in conjunction with a spiral rod 89, as shown in FIG. 2. The blades 80 are spirally arranged on the spiral rod 89 to enhance the shredding effect of the paper shredder. The prior art blade 80 can not be processed easily and is apt to become dull.

As shown in FIG. 3, another prior art blade 90 of the paper shredder is relatively cost-effective in view of the relatively small punched area 91 and the relatively large area of blade edge 92. In addition, the prior art blade 90 is less likely to become dull. However, the prior art blade 90 is defective in design in that the blade edges 92 thereof are smooth, thereby undermining the shredding effect of the prior art blade 90. In other words, the paper is apt to slide along the smooth surface of the blade edge 92. The blade edge 92 of the prior art blade 90 is devoid of means to arrest the paper to be shredded.

SUMMARY OF THE INVENTION

The primary objective of the present invention is to provide a paper shredder with a blade which is free from the drawbacks of the prior art blades described above.

In keeping with the principle of the present invention, the foregoing objective of the present invention is attained by a blade having a thin round body which is provided in the center thereof with a through hole and in the periphery thereof with at least one notch, thereby resulting in the formation of at least one blade edge. The blade is provide with a rugged peripheral surface.

DETAILED DESCRIPTION OF THE INVENTION

Figure 1:
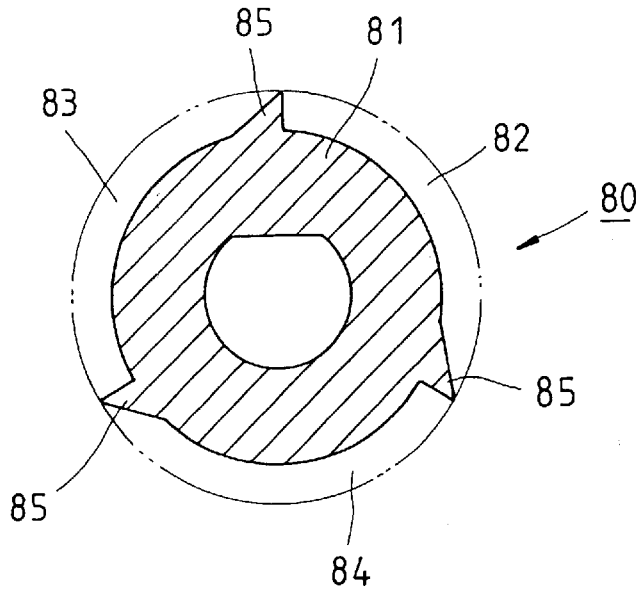
FIG. 1 (PRIOR ART)
FIG. 1 shows a schematic plan view of a prior art blade of the paper shredder.
Figure 3:
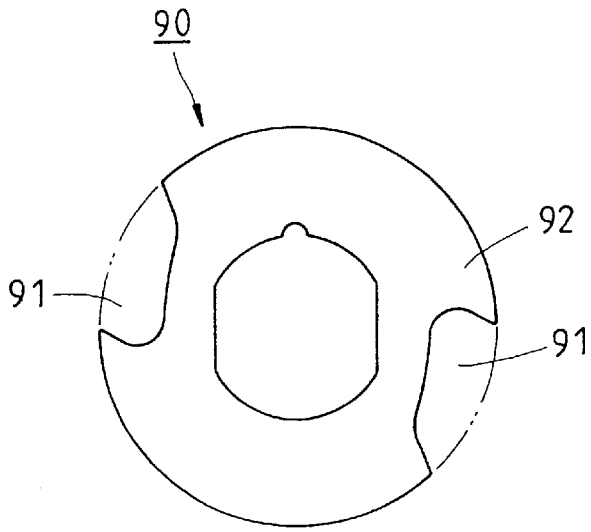
FIG. 3 (PRIOR ART)
FIG. 3 shows a schematic plan view of another prior art blade of the paper shredder.
Figure 2:
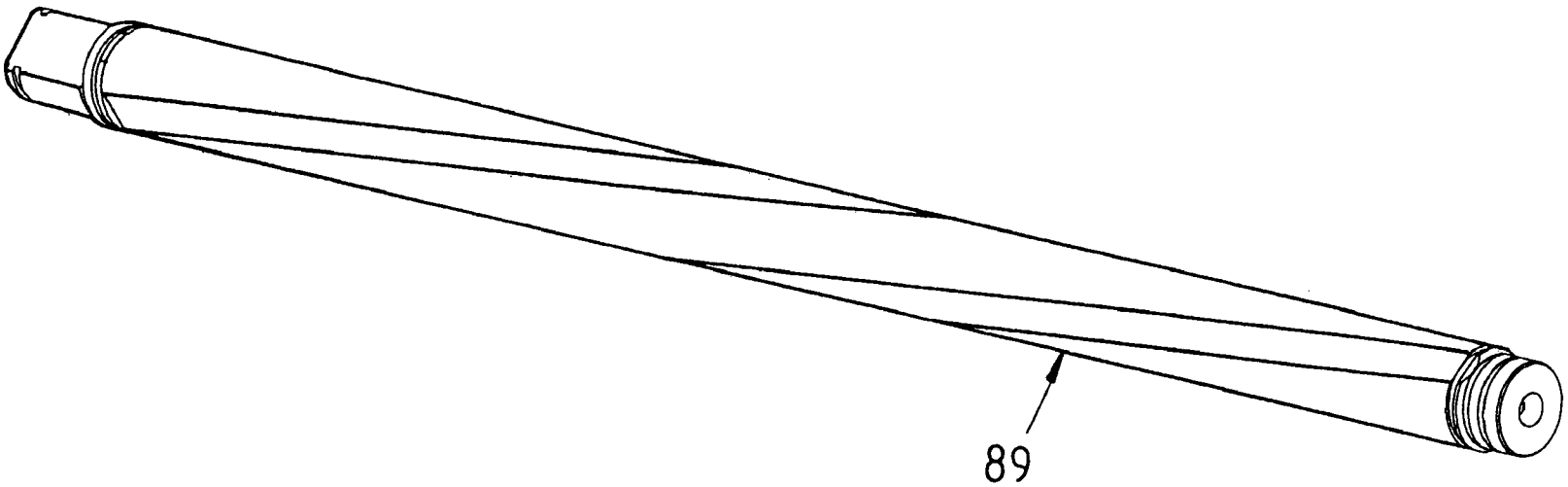
FIG. 2 (PRIOR ART)
FIG. 2 shows a schematic view of a spiral rod on which the prior art blades are mounted.
Figure 4:
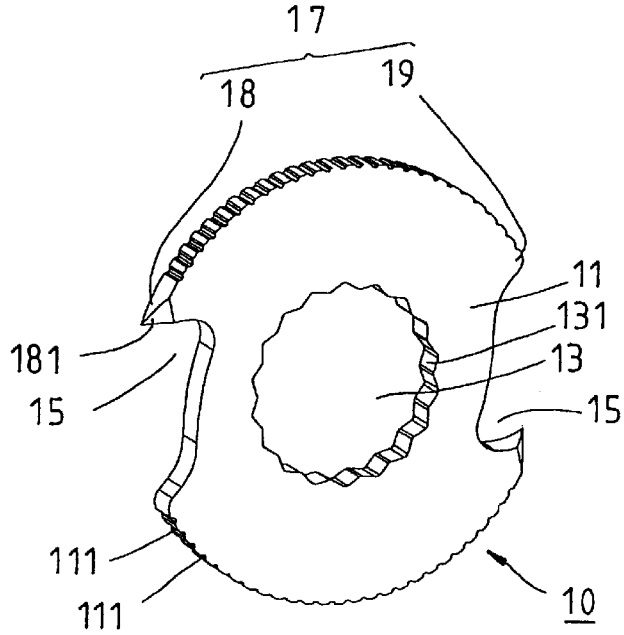
FIG. 4 shows a perspective view of a preferred embodiment of the present invention.
Figure 5:
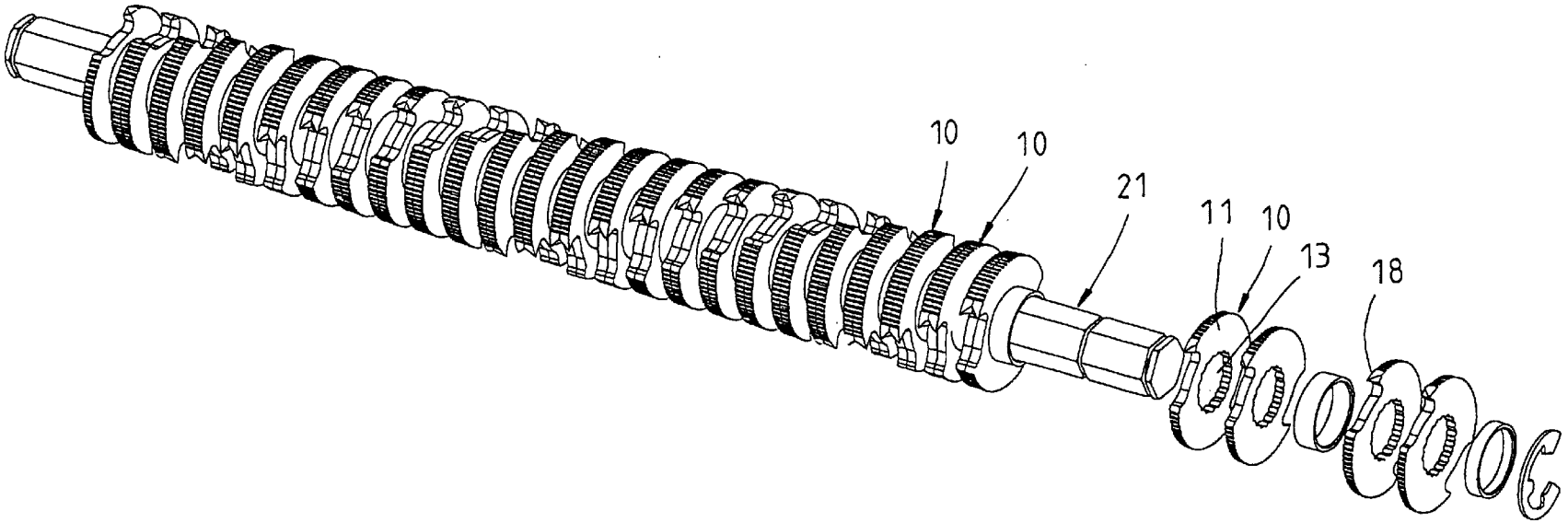
FIG. 5 shows a schematic view of a shaft rod on which a plurality of blades of the present invention are mounted.

As shown in FIGS. 4 and 5, a blade 10 embodied in the present invention is intended for use in the paper shredder and is formed of a main body 11, which is a round thin piece and is provided in the center thereof with a through hole 13. The blade 10 is provided in the circumferential periphery thereof with two notches 15, two blade edges 17, one edge head end 18, and one edge tail end 19.

The present invention is characterized by the edge head end 18 which is provided with an edge portion 181 by grinding. The edge portion 181 is pointed.

The blade 10 is provided along the edge thereof with a plurality of cavities 111, which make the edge rugged. The through hole 13 of the main body 11 is provided in the inner wall thereof with a plurality of recess angles 131. The shaft rod 21 has a hexagonal cross section. The blade 10 is fitted over the shaft rod 21 such that the recess angles 131 of the through hole 13 are retained on the outer surface of the shaft rod 21. A plurality of blades 10 are arranged spirally on the shaft rod 21, as shown in FIG. 5.

Figure 6:
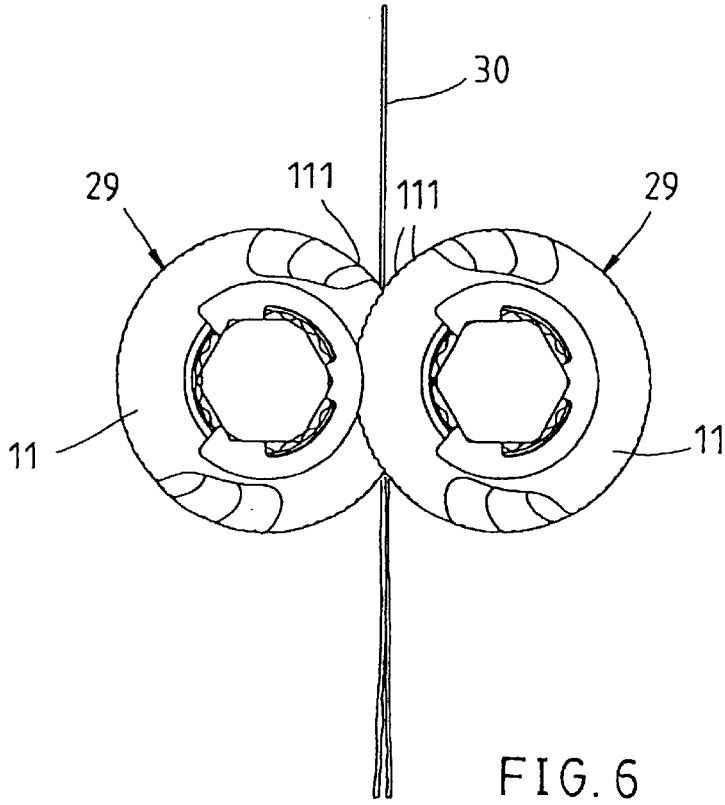
FIG. 6 shows a schematic view of the preferred embodiment of the present invention in action.

As illustrated in FIG. 6, a paper sheet 30 is fed into the rolling tool set 29 formed of the blades 10 such that the end of the paper sheet 30 comes in contact with the cavities 111. In light of friction, the paper sheet 30 is prevented from sliding along the outer edge of the blade 10. As a result, the paper sheet 30 is carried downwards between the rolling tool sets 29 to be shredded. In the shredding process, the paper sheet 30 is torn by the edge portions 181.

It is therefore readily apparent that the present invention has advantages over the blades of the prior art. In addition, the shaft rod of the present invention is relatively cost-effective, thanks to the hexagonal construction of the shaft rod.

What is claimed is:

1. A blade of a paper shredder, said blade comprising a round thin main body having in the center thereof a through hole engaged on a shaft rod, said main body provided in a circumferential edge thereof with at least one notch having a edge head end, and edge tail end, said at least one notch extending down from the circumferential edge toward the through hole;

wherein the circumferential edge has a plurality of cavities uniformly spaced from the edge head end to the edge tail end of the notch.

2. The blade as defined in claim 1, wherein said through hole of said main body is provided with a plurality of recess angles;

wherein said shaft rod is of a polygonal construction whereby said shaft rod is used to mount thereon said blade such that said recess angles of said through hole are retained on the outer surface of said shaft rod.

3. The blade as defined in claim 1, wherein said edge head end is provided with a pointed edge portion.

4. The blade as defined in claim 1, wherein there are two notches provided in the circumferential edge of the main body and the plurality of cavities are uniformly spaced on the circumferential edge from each said edge head end to each said edge tail end of the two notches.

* * * * *